US011296457B2

(12) United States Patent
Zhang

(10) Patent No.: US 11,296,457 B2
(45) Date of Patent: Apr. 5, 2022

(54) MAGNETIC CONNECTOR

(71) Applicant: ShenZhen QiHui Precision Hardware Co., Ltd., Shenzhen (CN)

(72) Inventor: Dehui Zhang, Shenzhen (CN)

(73) Assignee: DONGGUAN AIKEDE ELECTRONIC TECHNOLOGY CO., LTD, Dongguan (CN)

( * ) Notice: Subject to any disclaimer, the term of this patent is extended or adjusted under 35 U.S.C. 154(b) by 0 days.

(21) Appl. No.: 17/073,345

(22) Filed: Oct. 17, 2020

(65) Prior Publication Data

US 2021/0234302 A1 Jul. 29, 2021

Related U.S. Application Data

(63) Continuation of application No. PCT/CN2019/087501, filed on May 17, 2019.

(30) Foreign Application Priority Data

Apr. 18, 2018 (CN) ..... 201820546884.4
Nov. 16, 2018 (CN) ..... 201821907579.X
Apr. 18, 2019 (CN) ..... 201920534565.6

(51) Int. Cl.

| | |
|---|---|
| ***H01R 11/30*** | (2006.01) |
| ***H01R 13/62*** | (2006.01) |
| ***H01R 24/60*** | (2011.01) |
| *H01R 31/06* | (2006.01) |
| *H01R 107/00* | (2006.01) |

(52) U.S. Cl.

CPC ..... *H01R 13/6205* (2013.01); *H01R 24/60* (2013.01); *H01R 31/06* (2013.01); *H01R 2107/00* (2013.01)

(58) Field of Classification Search

CPC ..... H01R 13/6205; H01R 4/34; H01R 27/00; H01R 31/06; H01R 23/7073; H01R 24/60; H01R 2107/00

USPC ..... 439/38, 39, 40, 217, 218, 638, 660

See application file for complete search history.

(56) References Cited

U.S. PATENT DOCUMENTS 4,900,278 A * 2/1990 Yamada ..... H01R 13/193 439/857
5,649,837 A * 7/1997 Arnold ..... H01R 13/6315 439/247
5,904,581 A * 5/1999 Pope ..... H01R 24/60 439/74

(Continued)

FOREIGN PATENT DOCUMENTS

CN 204720676 U 10/2015
CN 205081327 U 3/2016

(Continued)

*Primary Examiner* — Thanh Tam T Le
(74) *Attorney, Agent, or Firm* — Andrew C. Cheng

(57) ABSTRACT

The invention discloses a magnetic connector, which includes a male connector and a female connector. The female connector includes a tongue assembly. The tongue assembly includes a first tongue and a pluralities of contact terminals disposed on the first tongue. A second tongue is defined on the male connector. A plurality of conductive terminals are disposed on the second tongue, the male connector and the female connector are magnetically attracted, and the contact terminals contact with the conductive terminals to achieve electrical connection.

16 Claims, 7 Drawing Sheets

(56) References Cited

U.S. PATENT DOCUMENTS

| | | | | |
|---|---|---|---|---|
| 7,329,128 | B1 * | 2/2008 | Awad | H01R 13/6205 439/38 |
| 8,092,241 | B2 * | 1/2012 | Chang | H01R 13/70 439/305 |
| 9,004,953 | B2 * | 4/2015 | Finona | H01R 13/6473 439/660 |
| 9,039,457 | B2 * | 5/2015 | Zhang | H01R 13/6275 439/660 |
| 9,209,547 | B2 * | 12/2015 | Lozano Villarreal | H01R 13/6666 |
| 9,263,818 | B2 * | 2/2016 | Lam | H01R 13/631 |
| 9,312,644 | B2 * | 4/2016 | Kao | H01R 13/6591 |
| 9,515,420 | B2 * | 12/2016 | Daoura | H01R 13/642 |
| 9,640,885 | B2 * | 5/2017 | Amini | H01R 12/7029 |
| 9,979,138 | B1 * | 5/2018 | Chen | H01R 13/7137 |
| 9,991,628 | B2 * | 6/2018 | Daoura | H01R 13/64 |
| 9,991,657 | B2 * | 6/2018 | Powers | H01R 31/06 |
| 10,333,249 | B1 * | 6/2019 | Wang | H01R 13/6205 |
| 10,658,793 | B2 * | 5/2020 | Blake | H01R 13/64 |
| 2015/0244105 | A1 * | 8/2015 | Peng | H01R 13/6205 439/39 |
| 2017/0093104 | A1 | 3/2017 | Powers et al. | |

FOREIGN PATENT DOCUMENTS

| | | | |
|---|---|---|---|
| CN | 105896168 | A | 8/2016 |
| CN | 206272026 | U | 6/2017 |
| CN | 108448347 | A | 8/2018 |

* cited by examiner

MAGNETIC CONNECTOR

FIELD OF THE INVENTION

The invention relates generally to the field of connectors, and in particular, to a magnetic connector.

BACKGROUND OF THE INVENTION

At present, the popular magnetic connector on the market is usually provided with pogo pins as the contact terminals, the male connector is in contact with the female connector by magnetic attraction to form an electrical connection. However, this kind of connection is unstable, and unable to withstand large current, and the cost of manufacturing is too high.

There is also another magnetic connector which is connected by magnetic attraction and mating with each other to increase the stability of the connecting, such as the connector disclosed in the patent CN105896168A, by providing a recess on the male connector and a protrusion on the female connector, the male connector and the female connector are magnetically attracted and are electrically connected by matching the recess with the protrusion to increase the success rate of the connecting. However, the recess and the protrusion are respectively provided on the male connector and the female connector, in order to avoid the male connector being too long, the recess cannot be made too long, that is to say, the length of the contact terminal in the recess is too short, eventually, it is difficult to form enough elastic force by its own shape, one side of the contact terminal mating with the pins is slightly convex to be in contact with each other only during the manufacturing.

SUMMARY OF THE INVENTION

The purpose of the invention is to provide a magnetic connector and the device having the same to overcome the shortcomings in the prior art.

In accordance with an aspect of the embodiment, there is provided a magnetic connector, the magnetic connector includes a male connector and a female connector, wherein the female connector includes a tongue assembly, the tongue assembly includes a first tongue and a pluralities of contact terminals disposed on the first tongue; a second tongue is defined on the male connector, a pluralities of conductive terminals are disposed on the second tongue, the male connector and the female connector are magnetically attracted, the contact terminals contact with the conductive terminals to achieve electrical connection.

Preferably, the first tongue includes a receiving space formed thereon, the contact terminals are defined in the receiving space, and the contact terminals electrically contact with the conductive terminals on the second tongue when the second tongue is inserted into the receiving space.

Preferably, the male connector includes a plug, the plug is further provided with a protrusion adjacent one side of the second tongue, a groove is defined between the protrusion and the second tongue, and the first tongue is disposed in the groove when the second tongue is inserted into the receiving space.

Preferably, the female connector further includes a first magnet, the first magnet is located on one side of the first tongue, the first tongue protrudes from the first magnet, the male connector further includes a second magnet, the second magnet is sleeved on the protrusion or integrally formed with the protrusion, and the second magnet and the first magnet are magnetically attracted.

Preferably, the female connector further includes a shell, the tongue assembly and the first magnet are disposed in the shell, a gap is defined between the first magnet and one end of the shell; and the male connector mates with the female connector from a side of the shell that is spaced from the first magnet.

Preferably, thereceiving space and the second tongue are both elongated, and the contact terminals are arranged in two rows, the contact terminals of the first row is GND, V+, D+, D, the other row is opposite to the first row and located on two opposite inner walls of the receiving space, the conductive terminals are correspondingly arranged in a single row or two rows and disposed on two opposite surface of the second tongue; or the receiving space and the second tongue are both elongated, the contact terminals are arranged in a single row, and the conductive terminals are correspondingly arranged in a single row or two rows and are disposed on opposite surfaces of the second tongue; or the receiving space and the second tongue are both cylindrical, and there are one or more than one of the contact terminal and the conducting terminal.

Preferably, the contact terminal is an elastic conductor, and the conductive terminal is elastically contact with the contact terminal.

Preferably, the end of the contact terminal is bent to form a bending portion, the first tongue provided with the conductive terminal arranged on the surface is inserted into the receiving space to press the bending portion of the contact terminal to form elastic contact.

Preferably, the receiving space extends through the first tongue, one end of the contact terminal away from the bending portion is exposed to the receiving space, and is electrically connected to the printed circuit board.

Preferably, the length of the second tongue inserted into the receiving space is between 0.6 mm and 1.2 mm, and the receiving space is provided with a chamfered at an end adjacent to the insertion of the second tongue.

Preferably, the length of the second tongue inserted into the receiving space is between 1.8 mm and 2.2 mm or between 1.5 mm and 2.2 mm.

Preferably, the contact terminal is in surface contact with the conductive terminal to form electrical connection after the second tongue is inserted into the receiving space, and the contact width is between 0.4 mm and 1.5 mm.

Preferably, the second tongue is formed on one side or two sides of the inner wall of the protrusion, the groove defined by the protrusion is used for receiving the tongue assembly, the contact terminal contacts with the conductive terminal to form electrical connection after the tongue assembly is received in the groove defined by the protrusion Preferably, the length of the contact terminal is between 5 mm and 10 mm.

Preferably, the length of the contact terminal is between 6 mm and 8 mm.

Preferably, the thickness of the second tongue is between 0.6 mm and 1.2 mm or between 0.3 mm and 2.5 mm.

Compared with the prior arts, the magnetic connector according to the present invention has the following advantages:

1. By providing the second tongue on the male connector and providing the first tongue on the female connector, the second tongue and the first tongue are assembled and matched at the same time when the magnetic attraction is realized, thereby increasing the stability of the connection.

2. By providing the second tongue on the male connector and the first tongue on the female connector, the second tongue and the first tongue are assembled and matched at the same time when the magnetic attraction is realized, thereby increasing the stability of the connection. Moreover, the receiving space is provided on the first tongue, the first tongue is disposed on the female connector, thus the length of the contact terminals is not limited as the length of the male connector is not long enough, that is to say, the length of the contact terminal is long enough so as to provide sufficient force arm when the contact terminals are in contact with the second tongue, so that the shorter second tongue is fastened, or the first tongue is pulled away from the contact terminals, and the elastic force is enough to make the contact terminal and the conductive terminal in close contact.
3. By providing the receiving space on the female connector, and providing the contact terminals on the inner walls on opposite sides of the receiving space, the first tongue is directly inserted into the receiving space to form the electrical connection with the contact terminals, and the traditional connection with pogo pins is discarded. It is possible to ensure good electrical conductivity by increasing the cross section of the contact terminals and to avoid loose contact.
4. The contact terminal is an elastic conductor. The contact terminals is elastically contact with the second tongue when it is pressed against the second tongue, so that there is an elastic force when the second tongue contacts the contact terminal, ensuring the stability of the connection, that is, the connection stability between the contact terminal and the conductive terminals of the second tongue.
5. The conductive terminals are arranged on one side or both sides of the second tongue so that the positive or negative connection are both realized when the second tongue is inserted in the receiving space and in contact with the contact terminal.
6. The length of the second tongue inserted into the receiving space is between 0.6 mm and 1.2 mm, between 1.8 and 2.2 mm or between 15 and 2.2 mm, and the receiving space is provided with the chamfered at the end adjacent to the insertion of the second tongue, thereby ensuring that there is a certain angle when the first tongue is inserted into the receiving space or when it is drawn from the receiving space. That is to say, it is not necessary to align with the tongue assembly completely, and insertion and extraction of the first tongue bring no damage to the first tongue when the certain angle exists.
7. By magnetically attracting the first magnet and the second magnet to each other, the strength of magnetic adsorption is increased.
8. The tongue assembly together with the first magnet is disposed in the shell, the space is defined between the first magnet and one side of the shell, the space is used for accommodating the second magnet and part of the male connector. The space is used to limit the male connector to prevent it from shaking when the male connector is mated with the tongue assembly. Meanwhile, the space is used for quick positioning to make each connection more convenient.
9. The contact terminal has a certain length, and can be used as a "lever", thereby having a large clamping force, so that the contact terminal generates a large clamping force against the second tongue to improve the stability of the connection.

DETAILED DESCRIPTION OF THE INVENTION

The invention will be described with reference to the accompanying drawings and the specifications. These and/or other aspects and advantages of the invention will become apparent and more readily appreciated from the following description of the embodiments, taken in conjunction with the accompanying drawings.

Figure 1:
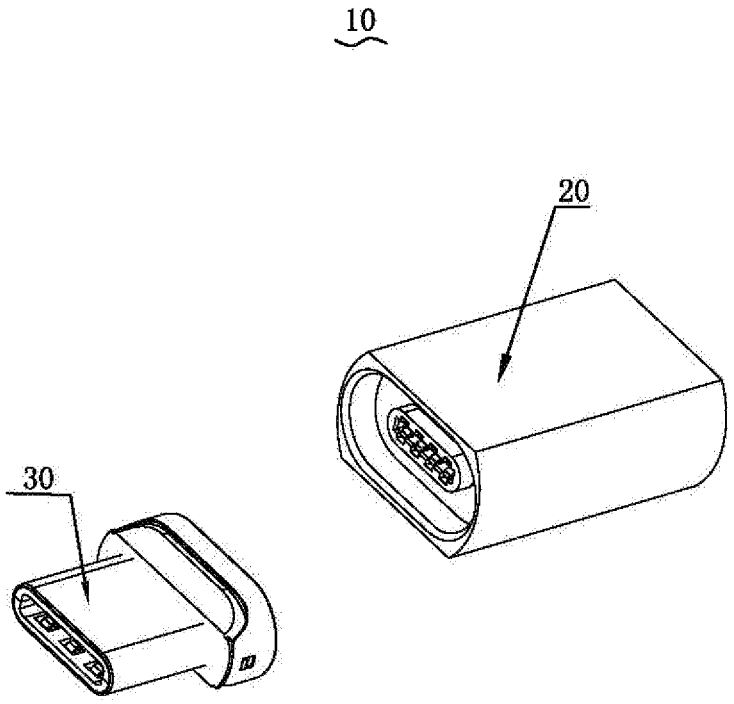
FIG. 1 is a perspective view of the magnetic connector according to the present invention.

Referring generally to FIG. 1, the present invention of the magnetic connector 10 includes a female connector 20 and a male connector 30, the male connector 30 and the female connector 20 are magnetically attracted, the male connector 30 mates with the female connector 20 to achieve electrical connection after they are magnetically attracted. When there is a need to charge and/or transmit data to the electronic device using the magnetic connector 10, different male connectors 30 can be magnetically attracted and mated with the female connector 20 in order to accommodate different types of electronic devices.

Figure 2A:
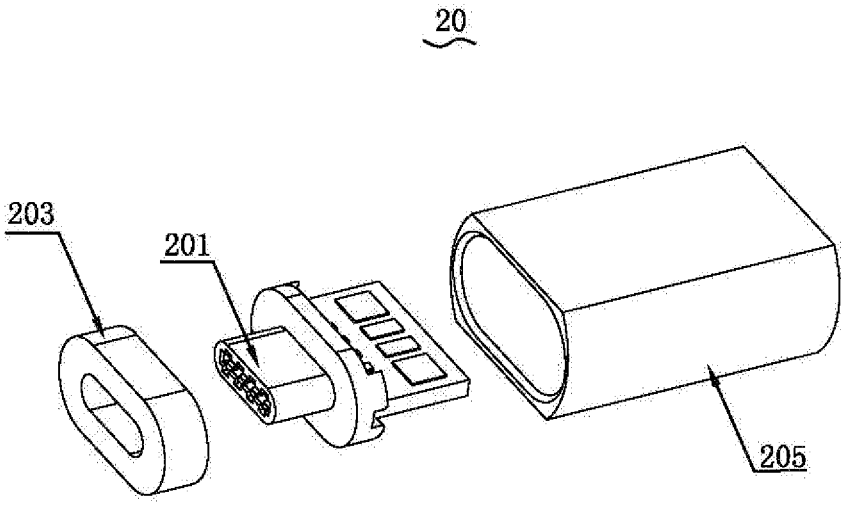
FIG. 2A is a perspective view showing the female connector.
Figure 2B:
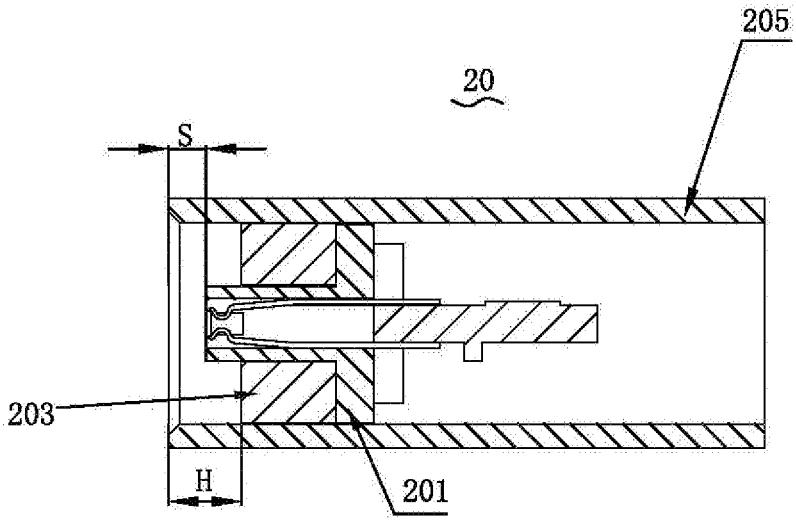
FIG. 2B is a sectional view showing the female connector.

Referring to FIGS. 2A and 2B, the female connector 20 includes a tongue assembly 201, a first magnet 203, and a shell 205. The first magnet 203 is disposed on one side of the tongue assembly 201 and is received in the shell 205 together with the tongue assembly 201. The female connector 20 is magnetically attracted with the male connector 30 via the first magnet 203, so as to connect the tongue assembly 201 with the male connector 30 to form an electrical connection.

It can be understood that the first magnet 203 is annular, or sleeved around the first tongue 2011, or semi-circular, or rectangular, etc., the first magnet 203 is connected to the side of the tongue assembly 201 that mates with the male connector 30, as long as it is magnetically attracted with the male connector 30, and the tongue assembly 201 is mated with the male connector 30.

In one embodiment, the shell 205 is integrally formed with the first magnet 203, or the shell 205 itself is magnetic as long as it is magnetically attracted to the male connector 30.

Specifically, a space H is defined between the first magnet 203 and one end of the shell 205 when the first magnet 203 and the tongue assembly 201 are received in the shell 205, the space is used for accommodating the male connector 30 when the male connector 30 is magnetically attracted with the first magnet 203. That is to say, when the male connector 30 needs to be mated with the female connector 20, the male connector 30 enters the shell 205 from the end of the shell 205 having the space H from the first magnet 203, and is magnetically attracted to the first magnet 203, and cooperates with the tongue assembly 201 to form the electrical connection, at this time, the male connector 30 is partially accommodated within the shell 205 for positioning the male connector 30 with the female connector 20 quickly each time.

Further, when the first magnet 203 and the tongue assembly 201 are received in the shell 205, the tongue assembly 201 has a distance S from one end of the shell 205, that is, the first tongue 2011 protrudes from the first magnet 203, and S≤H.

It can be understood that the first magnet 203 and the shell 205 and/or one end of the tongue assembly 201 is leveled, as long as the first magnet 203 can be magnetically attracted to the male connector 30, and the tongue assembly 201 can achieve the electrical connection with the male connector 30.

Figure 3A:
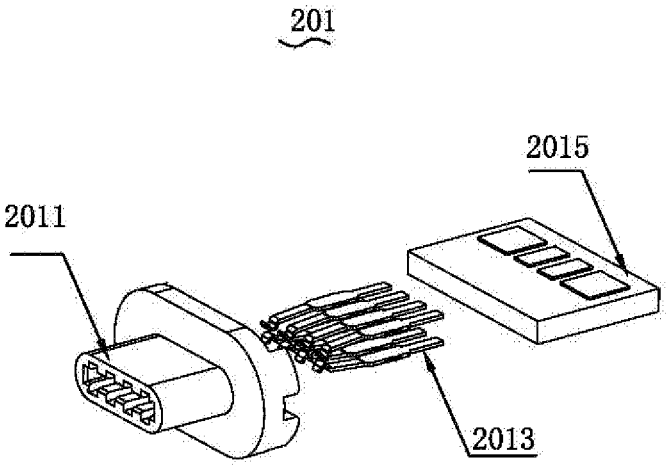
FIG. 3A is a perspective view showing the tongue assembly.
Figure 3B:
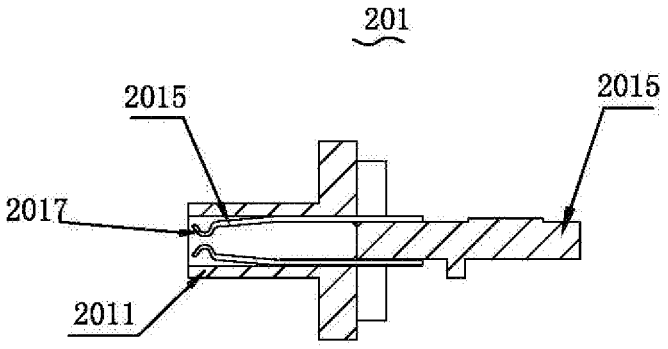
FIG. 3B is a sectional view showing the tongue assembly.
Figure 3C:
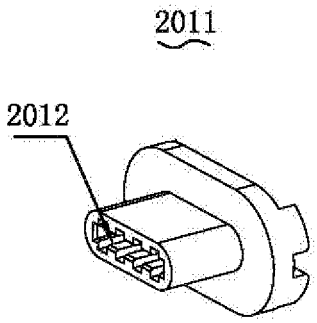
FIG. 3C is a perspective view showing the first tongue.
Figure 4A:
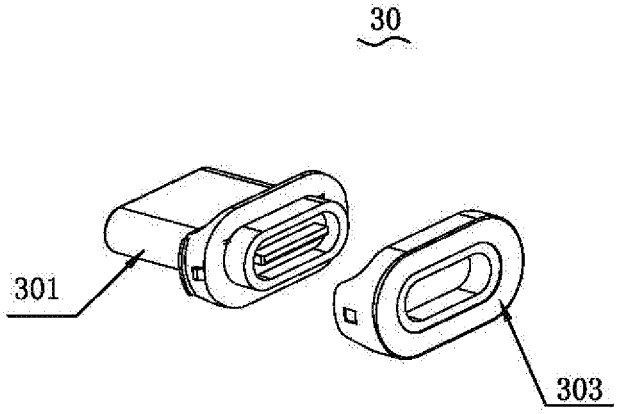
FIG. 4A is a perspective view showing the male connector.
Figure 4B:
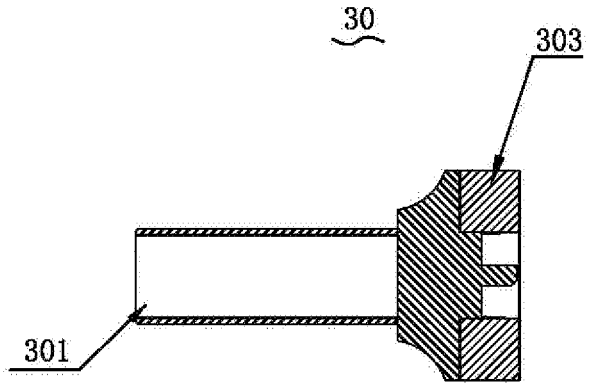
FIG. 4B is a sectional view showing the male connector.
Figure 4C:
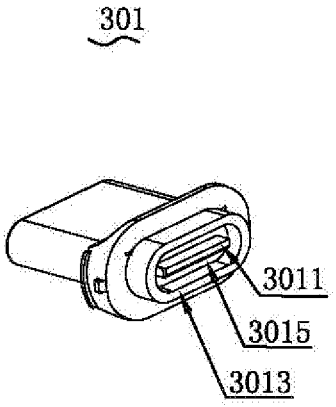
FIG. 4C is a perspective view showing the male connector.
Figure 4D:
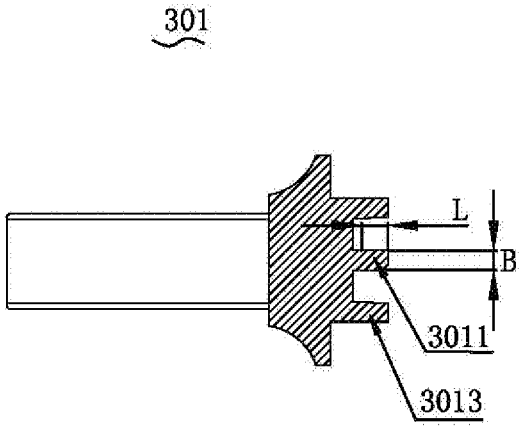
FIG. 4D is a sectional view showing the male connector.

Referring generally to FIGS. 3A to 3C, the tongue assembly 201 includes a first tongue 2011, a pluralities of contact terminals 2013 and a printed circuit board 2015. The contact terminals 2013 are disposed in the first tongue 2011 and electrically connect with the printed circuit board 2015, when the male connector 30 is engaged with the tongue assembly 201, the contact terminals 2013 contact the male connector 30 to form electrical connection, thereby forming the electrical connection with the printed circuit board 2015.

Specifically, the first tongue 2011 is provided with a receiving space 2012 extending through the first tongue 2011, and the contact terminals 2013 are disposed on the inner wall of the receiving space 2012. When the male connector 30 is engaged with the tongue assembly 201, the male connector 30 partially enters the receiving space 2012, and contacts with the contact terminals 2013 in the receiving space 2012 to form electrical connection.

Further, the contact terminals 2013 are arranged in two parallel rows and disposed on the inner walls of the opposite sides of the receiving space 2012, the contact terminals 2013 of the first row is GND, V+, D+, D, the other row is opposite to the first row. The side of the contact terminals 2013 away from the male connector 30 is respectively connected to the opposite surfaces of the printed circuit board 2015 to form electrical connection with the printed circuit board 2015.

Further, the contact terminal 2013 is an elastic conductor, and the end portion of one side of the contact terminal 2013 away from the printed circuit board 2015 bends away from the inner wall of the receiving space 2012 to form a bending portion 2017. When the male connector 30 is engaged with the tongue assembly 201, the bending portion 2017 is elastically contact with the male connector 30, that is, when the contact terminals 2013 are connected with the male connector 30, the opposite sides of the contact terminals 2013 are pressed by the male connector 30, thus the contact terminals 2013 on the opposite sides have an elastic force in the direction of the male connector 30, in order to achieve more stable connection and better contact effect.

It can be understood that one end of the contact terminal 2013 away from the bent portion 2017 is exposed to the receiving space 2012 to form electrical connection with the printed circuit board 2015, so that the contact terminal 2013 is long enough, thus a sufficient force arm is formed at the bending portion 2017. After the second tongue 3011 is inserted into the receiving space 2012, the contact terminals 2013 are sufficiently elastic to be in close contact with the second tongue 3011.

Referring to FIGS. 4A to 4D, the male connector 30 includes a plug 301 and a second magnet 303. The second magnet 303 is disposed on one side of the plug 301 and is coupled to the plug 301. The second magnet 303 is magnetically attracted to the first magnet 203 to achieve magnetic attraction of the male connector 30 and the female connector 20. When the second magnet 303 is magnetically attracted to the first magnet 203, the plug 301 is mated with the tongue assembly 201 to form electrical connection.

Specifically, the side of the plug 301 adjacent to the second magnet 303 is provided with a second tongue 3011. When the male connector 30 is engaged with the female connector 20, the second magnet 303 and the first magnet 203 are magnetically attracted, and the second tongue 3011 enters the receiving space 2012 to contact with the contact terminals 2013 to form electrical connection. That is, the second tongue 3011 forms a plug-fit engagement with the contact terminals provided on opposite sides of the inside of the accommodating space 2012. The thickness of the tongue is between 0.6 mm and 1.2 mm or between 0.3 mm and 2.5 mm.

It can be understood that the distance between the opposite sides of the bending portions 2017 is smaller than the thickness B of the second tongue 3011, so that when the second tongue 3011 is inserted into the receiving space 2012, the contact terminals 2013 are pressed to contact the contact terminals 2013, one side of the contact terminal is subjected to a force, thereby causing an elastic deformation, which generates an elastic force toward the second tongue 3011 to achieve elastic contact of the second tongue 3011 with the contact terminal 2013. The contact terminal 2013 has a certain length, and can be used as a "lever", thereby having a large clamping force, so that the contact terminal 2013 generates a large clamping force against the second tongue 3011 to improve the stability of the connection. Alternatively, the length of the contact terminal 2013 is between 5 mm and 10 mm, or between 6 mm and 8 mm. It can be understood that there may be a gap between the end of the contact terminal 2013 away from the printed circuit board 2015 and the inner wall of the receiving space 2012, so that the contact terminal 2013 moves in the direction of the gap after being pressed by the second tongue 3011. There may be no gap between the end of the contact terminal 2013 away from the printed circuit board 2015 and the inner wall of the receiving space 2012, and plastic deformation is caused by the elasticity of the material itself when pressed by the second tongue 3011. When the second tongue 3011 is inserted into the receiving space 2012, it may be in elastic contact with the contact terminal 2013.

It can be understood that the second magnet 303 may be annular, sleeved around the tongue 3011, or may be semicircular, rectangular, or the like, and connected to the side of the connecting head 301 and the tongue assembly 201, as long as it can be magnetically attracted with the male connector 30, and the second tongue 3011 can enter the receiving space 2012 to be in contact with the contact terminal 2013.

As an embodiment, one of the first magnet 203 and the second magnet 303 may be a magnet, and the other may be a metal material that can be magnetically attracted. Preferably, the first magnet 203 and the second magnet 303 are both magnets order to increase the magnetic attraction force.

It can be understood that the size of the plug 301 and the second magnet 303 are adapted to the size of the shell 205 such that, the second magnet 303 is received in the shell 205 and is fitted with the inner wall of the shell 205 when the male connector 30 is mated with the female connector 20, and the plug 301 is partially received in the shell 205.

The conductive terminals (not shown) are disposed on the second tongue 3011. The second tongue 3011 enters the receiving space 2012 to contact the contact terminals 2013, that is to say, the conductive terminals and the contact terminals on the second tongue 3011 contact each other to form electrical connection. That is, the contact terminals 2013 are in electrical contact with the second tongue 3011, and are actually in electrical contact with the conductive terminals on the second tongue 3011.

The conductive terminals are disposed on one or two opposite sides of the second tongue 301, the contact terminals 2013 are disposed on the inner walls of two opposite sides of the receiving space 2012. When the second tongue 3011 is mated with the contact terminals 2013, it can be flipped by 180° as long as the conductive terminals are in contact with the contact terminals 2013 on one side. That is to say, the second tongue 3011 and the contact terminals 2013 work both in positive and negative insertion.

It can be understood that the conductive terminals on the second tongue 3011 are alternatively disposed only on one side, the contact terminals 2013 in the receiving space 2012 is also disposed only on one inner wall, one side of the second tongue 3011 on which the conductive terminals are disposed is inserted into the side of the receiving space 2012 where the contact terminals 2013 are provided, electrical connection is also achieved.

As an embodiment, alternatively, the second tongue 3011 is cylindrical, and the conductive terminals are disposed on the cylindrical surface of the second tongue 3011. The receiving space 2012 disposed on the corresponding first tongue 2011 is also cylindrical and adapted with the second tongue 3011, as long as the second tongue 3011 can be inserted into the receiving space 2012 and the conductive terminals are in contact with the contact terminals 2013 to form a point contact.

It can be understood that the conductive terminal and the contact terminal 2013 are preferably in surface contact with each other to form electrical connection, and the electrical connection is formed by surface contact, and the cross-sectional area contact is larger than the electrical connection formed by a point contact or a line contact, thus larger current is acceptable.

It can be understood that the conductive terminal and the contact terminal 2013 both include two opposite main surfaces, the two are both in surface contact by the contact of the main surfaces, and the width of the contact between the conductive terminal and the contact terminal is between 0.4 mm and 1.5 mm.

One side of the plug 301 adjacent to the second tongue 3011 is further provided with a protrusion 3013, the protrusion 3013 is disposed around the second tongue 3011, the second magnet 303 is sleeved on the protrusion 3013, so that the connection between the second magnet 303 and the connector 301 is more stable. A groove 3015 is defined between the protrusion 3013 and the second tongue 3011, the first tongue 2011 is disposed in the groove 3015 when the second tongue 3011 is inserted into the receiving space 2012. Preferably, the size of the first tongue 2011 is adapted to that of the groove 3015. In an alternative embodiment, the protrusion 3013 is integrally formed with the second tongue 3011, the second tongue 3011 is formed on one side or two sides of the inner wall of the protrusion 3013. The second tongue 3011 is provided with the contact terminals. The groove 3015 defined by the protrusion 3013 is used for receiving the tongue assembly 201. The tongue assembly 201 is provided with the conductive terminals 2013, the contact terminals are elastically contact with the conductive terminals. A clamping force is formed by the leverage of the contact terminal 2013, so as to force one side that is in contact with the contact terminal 2013 to generate an elastic deformation, thus an elastic force is generated in the direction towards the second tongue 3011 to achieve elastic contact between the second tongue 3011 and the contact terminals 2013.

It can be understood that the second magnet 303 is integrally formed with the protrusion 3013. The protrusion 3013 is the second magnet 303, that is to say, the second magnet 303 is directly sleeved around the second tongue 3011 and a groove is formed between the second tongue 3011 and the second magnet 303.

In order to ensure that the easy assembling and stable connection between the second tongue 3011 and the contact terminals 2013, it is preferable that the length L of the second tongue 3011 inserted into the receiving space 2012 is between 0.6 mm and 1.2 mm, or between 1.8 mm and 2.2 mm, or between 1.5 mm and 2.2 mm. It is preferably between 0.8 mm and 1.0 mm, further preferably 0.9 mm. In order to achieve the length inserted into receiving space 2012, a limiting piece (not shown) is provided in the receiving space 2012 so as to restrict the length of the second tongue 3011 inserted into the receiving space 2012.

Regarding the easy assembling, it means that the second tongue 3011 can be smoothly inserted into the receiving space 2012 provided with the contact terminals 2013 or the second tongue 3011 can be pulled out without damaging the second tongue 3011, even when the initial position of the second tongue 3011 and the receiving space 2012 is not completely parallel while being plugged, or even when the second tongue 3011 is pulled out from the receiving space 2012 but not in the direction parallel to the length L of the second tongue 3011.

Further, the receiving space 2012 is provided with a chamfered at an end adjacent to the insertion of the second tongue 3011, which further facilitates the insertion of the second tongue 3011 and the receiving space.

In one embodiment, the receiving space 2012 is defined on the male connector, the contact terminals are defined in the receiving space 2012, the contact terminals 2013 electrically contact with the plug 301. The second tongue 3011 is defined on the female connector 20, the conductive terminals are defined in the second tongue 3011, the second tongue 3011 electrically contact with the printed circuit board 2015. As long as the male connector 30 and the female connector 20 are magnetically attractive and the second tongue 3011 is mated with the receiving space 2012 and electrically connects to the contact terminals 2013.

In one embodiment, the contact terminals 2013 are disposed on the second tongue 3011, the conductive terminals are disposed on the inner wall of the receiving space of the first tongue, one end of the contact terminal 2013 contacting the conductive terminal is bent towards one side away from the second tongue 3011, thus the contact terminals 2013 electrically contact with the conductive terminals when the second tongue 3011 is inserted into the receiving space 2012, and the conductive terminals and the contact terminals 2013 are in elastic contact.

Figure 5A:
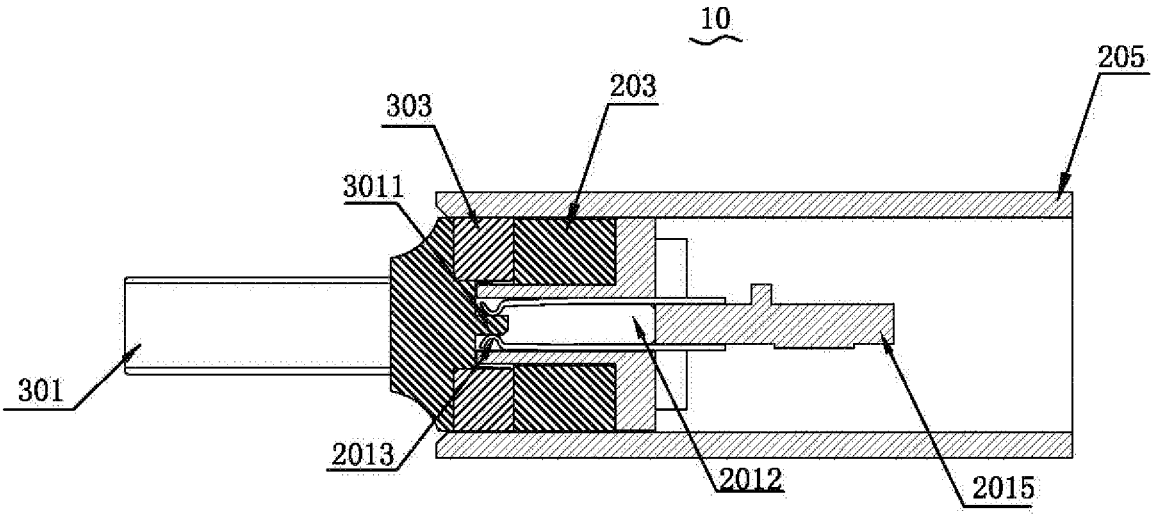
FIG. 5A is an assembled view of the male connector and the female connector.
Figure 5B:
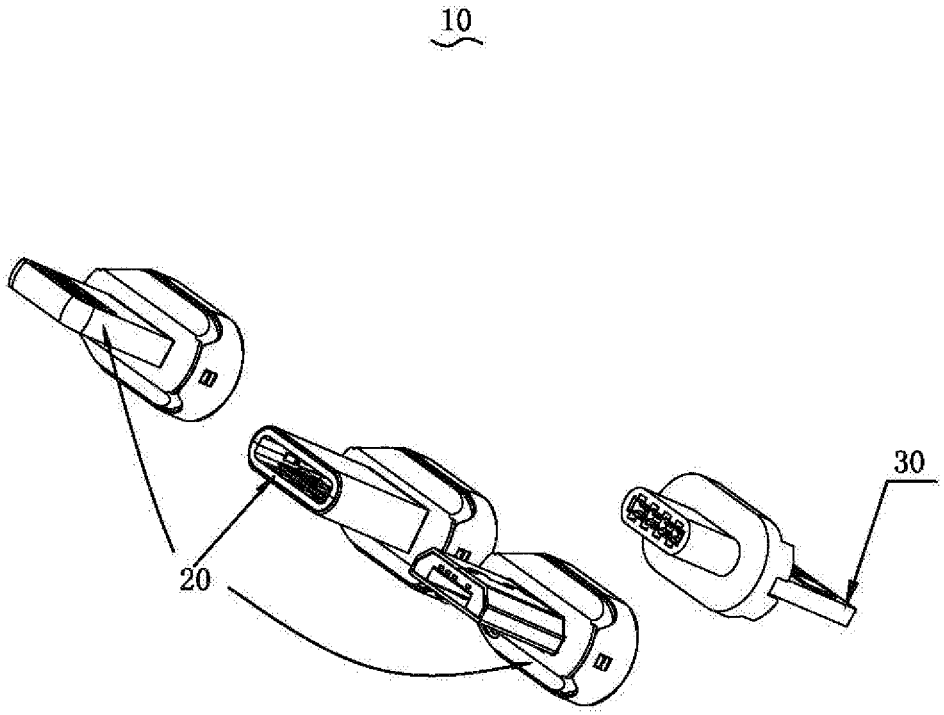
FIG. 5B is a perspective view showing the female connector for adapting different types of male connectors.

Referring to FIGS. 5A-5B, when the magnetic connector 10 is needed, keep one side of the plug 301 provided with the second tongue 3011 close to the male connector, the second magnet 303 is magnetically attracted to the first magnet 203, the second tongue 3011 is inserted into the receiving space 2012 and contact with the contact terminals to form the electrical connection. When the magnetic connector 10 is not needed, the plug 301 is drawn from the female connector 20, that is to say, the second tongue 3011 is withdrawn from the receiving space 2012, and no longer electrically connects to the contact terminals 2013.

Alternatively, the printed circuit board 2015 is electrically connected to an external power supply, one side of the plug 301 away from the second tongue 3011 is connected to an external electronic device, the external electronic device is charged by electrically connecting the second tongue 3011 and the contact terminals 2013.

It can be understood that the plug 301 is alternatively a lightning plug, an Android plug, a type-c plug, etc., as long as it is electrically connected with the external electronic device, and the plug 301 is provided with the second tongue 3011 on one side and mated with the female connector 20.

It can be understood that the plug 301 mates with the female connector 20 to form a data connection or to form a data connection or to form an electrical connection and a data connection at the same time.

It can be understood that the shell 205 can be omitted as long as the first magnet 203 and the second magnet 303 is magnetically attracted, and the electrical connection is formed when the second tongue 3011 is inserted into the receiving space 2012 and contacts with the contact terminals 2013.

The present invention also provides a device provided with the magnetic connector 10, the female connector 20 is disposed on the device, electrically connects with the device via the printed circuit board 2015, and connects to the external electronic device via the device or the power supply provided by itself, thereby, the magnetic connector 10 can provide power to the electronic device, when the male connector 30 mates with the female connector 20.

If the device is a magnetic cable connector, the female connector 20 electrically connects with the printed circuit board 2015 via the cable, the other end of the cable is provided with a USB interface, the male connector 30, the female connector 20 and the cable are assembled to form the magnetic cable connector. Alternatively, if the device is a mobile power source, the female connector 20 is directly connected to the mobile power source via the circuit board 2015. The female connector 20 mates with the male connector 20 to charge the electronic device after the female connector connects with the electronic device.

Alternatively, if the device is a storage device, the female connector 20 communicates data with the storage device via the circuit board 2015, the male connector 20 communicates data with the electronic device, the data communication between the storage device and the electronic device is realized, after the male connector 30 and the female connector 20 are magnetically attracted and fitted together. That is to say, the data in the electronic device is imported into the storage device, or the data in the device of the storage device is imported into the electronic device. In other words, the storage device is a USB flash drive having a magnetic connector 10 or a mobile hard disk having the same.

For example, the device is alternatively an adapter device, and the female connector 20 is electrically connected to one end of the adapter device, and the other end of the adapter device is a micro, or a USB, or a lightning, or a type-c interface. The male connector 30, the female connector 20 and the adapter device are mated to achieve electrical connection between different electronic devices with different signals.

It can be understood that the device is an electronic device such as a cable, a mobile power, an adapter, a USB flash drive, a mobile hard disk, or the like, as long as it has the magnetic connector 10.

It can be understood that the female connector 20 is alternatively integrally formed with the device, that is, the female connector 20 is directly disposed on the device, as long as the male connector 30 and the female connector 20 are magnetically attracted and matched to achieve the electronic connection.

Compared with the prior arts, the magnetic connector according to the present invention has the following advantages:

1. By providing the second tongue on the male connector and providing the first tongue on the female connector, the second tongue and the first tongue are assembled and matched at the same time when the magnetic attraction is realized, thereby increasing the stability of the connection.
2. By providing the second tongue on the male connector and the first tongue on the female connector, the second tongue and the first tongue are assembled and matched at the same time when the magnetic attraction is realized, thereby increasing the stability of the connection. Moreover, the receiving space is provided on the first tongue, the first tongue is disposed on the female connector, thus the length of the contact terminals is not limited as the length of the male connector is not long enough, that is to say, the length of the contact terminal is long enough so as to provide sufficient force arm when the contact terminals are in contact with the second tongue, so that the shorter second tongue is fastened, or the first tongue is pulled away from the contact terminals, and the elastic force is enough to make the contact terminal and the conductive terminal in close contact.
3. By providing the receiving space on the female connector, and providing the contact terminals on the inner walls on opposite sides of the receiving space, the first tongue is directly inserted into the receiving space to form the electrical connection with the contact terminals, and the traditional connection with pogo pins is discarded. It is possible to ensure good electrical conductivity by increasing the cross section of the contact terminals and to avoid loose contact.
4. The contact terminal is an elastic conductor. The contact terminals is elastically contact with the second tongue when it is pressed against the second tongue, so that there is an elastic force when the second tongue contacts the contact terminal, ensuring the stability of the connection, that is, the connection stability between the contact terminal and the conductive terminals of the second tongue.
5. The conductive terminals are arranged on one side or both sides of the second tongue so that the positive or negative connection are both realized when the second tongue is inserted in the receiving space and in contact with the contact terminal.
6. The length of the second tongue inserted into the receiving space is between 0.6 mm and 1.2 mm, between 1.8 and 2.2 mm or between 1.5 and 2.2 mm, and the receiving space is provided with the chamfered at the end adjacent to the insertion of the second tongue, thereby ensuring that there is a certain angle when the first tongue is inserted into the receiving space or when it is drawn from the receiving space. That is to say, it is not necessary to align with the tongue assembly completely, and insertion and extraction of the first tongue bring no damage to the first tongue when the certain angle exists.

7. By magnetically attracting the first magnet and the second magnet to each other, the strength of magnetic adsorption is increased.
8. The tongue assembly together with the first magnet is disposed in the shell, the space is defined between the first magnet and one side of the shell, the space is used for accommodating the second magnet and part of the male connector. The space is used to limit the male connector to prevent it from shaking when the male connector is mated with the tongue assembly. Meanwhile, the space is used for quick positioning to make each connection more convenient.
9. The contact terminal has a certain length, and can be used as a "lever", thereby having a large clamping force, so that the contact terminal generates a large clamping force against the second tongue to improve the stability of the connection.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The invention claimed is:

1. A magnetic connector for a cable, comprising:

a male connector and a female connector, wherein the female connector comprises a tongue assembly, and a first magnet, the tongue assembly comprises a first tongue, a printed circuit board and a plurality of contact terminals disposed on the first tongue; the plurality of contact terminals are electrically connected to the printed circuit board, the first magnet is disposed at a side the first tongue, the male connector comprises a second tongue, a connecting head, a second magnet and a plurality of conductive terminals disposed on the second tongue, the second magnet is disposed at a side of the connecting head and is connected to the connecting head, and the second tongue is disposed at the side of the connecting head close to the second magnet; the second magnet and the first magnet are magnetically attached;

the first tongue defines a receiving space where the contact terminals disposed therein, the conductive terminals are disposed on two opposite surfaces of the second tongue, when the male connector and the female connector are magnetically attracted, the second tongue is inserted into the receiving space, and the contact terminals are electrically connected to the conductive terminals.

2. The magnetic connector as defined in claim 1, wherein the male connector comprises a plug, the plug is further provided with a protrusion on a side adjacent to the second tongue, a groove is defined between the protrusion and the second tongue, when the second tongue is inserted into the receiving space, the first tongue is disposed in the groove.

3. The magnetic connector as defined in claim 2, wherein the first tongue protrudes from the first magnet, the second magnet is sleeved on the protrusion or integrally formed with the protrusion.

4. The magnetic connector as defined in claim 3, wherein the female connector further comprises a shell, the tongue assembly and the first magnet are disposed in the shell, a space is formed between the first magnet and one end of the shell, for receiving the male connector; and the male connector mates with the female connector from a side of the shell that is spaced from the first magnet.

5. The magnetic connector as defined in claim 2, wherein the second tongue is formed on one side or two sides of an inner wall of the protrusion, the groove defined by the protrusion is used for receiving the first tongue and an end of the contact terminals closed to the male connector, when the first tongue and the end of the contact terminals closed to the male connector are received in the groove, the contact terminals contact with the conductive terminals to form an electrical connection.

6. The magnetic connector as defined in claim 1, wherein the receiving space and the second tongue are both elongated, and the contact terminals are arranged in two rows, the contact terminals in one row is in sequence of GND, V+, D+, D, the other row is opposite to the row and located on two opposite inner walls of the receiving space, the conductive terminals are correspondingly arranged in a single row or two rows; or the receiving space and the second tongue are both elongated, the contact terminals are arranged in a single row, and the conductive terminals are correspondingly arranged in a single row or two rows and are disposed on two opposite surfaces of the second tongue; or the receiving space and the second tongue are both cylindrical, the contact terminals and the conducting terminals are respectively configured as one or more.

7. The magnetic connector as defined in claim 1, wherein the contact terminals are elastic conductors, and the conductive terminals elastically contact with the contact terminals.

8. The magnetic connector as defined in claim 7, wherein an end of the contact terminals connected to the second tongue is bent to form a bending portion, the conductive terminals arranged on the surface of the second tongue, the second tongue is inserted into the receiving space to press the bending portion of the contact terminals to form an elastic contact.

9. The magnetic connector as defined in claim 8, wherein the receiving space extends through the first tongue, another end of the contact terminals away from the bending portion is exposed to the receiving space, and is electrically connected to the printed circuit board.

10. The magnetic connector as defined in claim 1, wherein the length of the second tongue inserted into the receiving space is between 0.6 mm and 1.2 mm, and the receiving space is provided with a chamfered at an end adjacent to the insertion of the second tongue.

11. The magnetic connector as defined in claim 1, wherein the length of the second tongue inserted into the receiving space is between 1.8 mm and 2.2 mm or between 1.5 mm and 2.2 mm.

12. The magnetic connector as defined in claim 1, wherein when the second tongue is inserted into the receiving space, the contact terminals are in a surface contact with the conductive terminals to form an electrical connection, and the contact width between the conductive terminals and the contact terminals is between 0.4 mm and 1.5 mm.

13. The magnetic connector as defined in claim 1, wherein the length of the contact terminals is between 5 mm and 10 mm.

14. The magnetic connector as defined in claim 13, wherein the length of the contact terminals is between 6 mm and 8 mm.

15. The magnetic connector as defined in claim 1, wherein the thickness of the second tongue is between 0.6 mm and 1.2 mm or between 0.3 mm and 2.5 mm.

16. The magnetic connector as defined in claim 1, wherein the magnetic connector is a magnetic data cable.

* * * * *